US012338699B1

(12) United States Patent
Yang et al.

(10) Patent No.: US 12,338,699 B1
(45) Date of Patent: Jun. 24, 2025

(54) REAL TIME AUTOMATED CONTROL METHOD FOR WIRELINE DOWNHOLE DEBRIS COLLECTING WHILE MILLING OPERATION

(71) Applicant: Schlumberger Technology Corporation, Sugar Land, TX (US)

(72) Inventors: Xuedong Yang, Sugar Land, TX (US); Robert Kyle Wiesenborn, Sugar Land, TX (US); Maxim Klyuzhev, Sugar Land, TX (US); Rishi Mishra, Sugar Land, TX (US); Idalia Stevenson, Sugar Land, TX (US); Mohammad Irfan Uddin, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/768,776

(22) Filed: Jul. 10, 2024

(51) Int. Cl.
*E21B 27/00* (2006.01)
*E21B 37/00* (2006.01)

(52) U.S. Cl.
CPC ..... *E21B 27/00* (2013.01); *E21B 37/00* (2013.01)

(58) Field of Classification Search
CPC ..... E21B 27/00; E21B 37/00
See application file for complete search history.

(56) References Cited

U.S. PATENT DOCUMENTS

| | | | | |
|---|---|---|---|---|
| 7,478,687 | B2 | 1/2009 | Lynde | |
| 8,453,724 | B2 | 6/2013 | Zhou | |
| 9,920,613 | B2 | 3/2018 | Lee | |
| 10,072,472 | B2 * | 9/2018 | Jensen | E21B 27/00 |
| 10,526,845 | B2 | 1/2020 | Grabæk | |
| 10,704,351 | B2 | 7/2020 | Haugland | |
| 10,767,447 | B2 | 9/2020 | Kartha | |
| 10,858,900 | B2 | 12/2020 | Haugland | |
| 11,111,748 | B2 | 9/2021 | Mahajan | |
| 11,125,033 | B2 | 9/2021 | Edvardsen | |
| 11,319,763 | B2 | 5/2022 | Haugland | |
| 2009/0279966 | A1 | 11/2009 | Blair | |
| 2011/0127044 | A1 * | 6/2011 | Radford | E21B 10/322 166/212 |

(Continued)

FOREIGN PATENT DOCUMENTS

| | | | |
|---|---|---|---|
| DK | 180023 | B1 | 1/2020 |
| EP | 2458134 | A2 | 5/2012 |

(Continued)

*Primary Examiner* — Shane Bomar
(74) *Attorney, Agent, or Firm* — Jeffrey D. Frantz

(57) ABSTRACT

A method for milling and removing debris in a wellbore, comprising: moving a collecting while milling (CWM) tool downhole into the wellbore; and conducting a first operation with the CWM tool, wherein the first operation comprises: a first cycle including operating a motor of the CWM tool at a first torque and a first speed, wherein the first operation includes milling an obstruction in a wellbore; and a second cycle including operating the motor of the CWM tool at a second torque and second speed to power a centrifugal pump to circulate wellbore fluid through a bailer of the CWM tool to collect debris, wherein the first torque is greater than the second torque and the second speed is greater than the first speed.

26 Claims, 6 Drawing Sheets

(56) References Cited

U.S. PATENT DOCUMENTS

| | | | | |
|---|---|---|---|---|
| 2015/0083392 | A1* | 3/2015 | Stowe | E21B 27/00 166/99 |
| 2015/0152704 | A1* | 6/2015 | Tunget | E21B 17/05 166/299 |
| 2017/0306724 | A1* | 10/2017 | Forstner | E21B 37/00 |
| 2018/0029869 | A1 | 2/2018 | Carapelli | |
| 2020/0332615 | A1* | 10/2020 | Wiesenborn | E21B 31/107 |
| 2021/0372220 | A1* | 12/2021 | Garcia | H01F 7/0257 |
| 2022/0220827 | A1 | 7/2022 | Haugland | |
| 2024/0418050 | A1* | 12/2024 | Sheiretov | E21B 29/00 |

FOREIGN PATENT DOCUMENTS

| | | | |
|---|---|---|---|
| EP | 2516793 | B1 | 4/2017 |
| EP | 3387212 | B1 | 8/2020 |
| NO | 342058 | B1 | 3/2018 |
| WO | 2020122732 | A1 | 6/2020 |
| WO | 2021226214 | A1 | 11/2021 |

* cited by examiner

REAL TIME AUTOMATED CONTROL METHOD FOR WIRELINE DOWNHOLE DEBRIS COLLECTING WHILE MILLING OPERATION

BACKGROUND

Obstructions can develop in a wellbore that impede wellbore operations. Conventionally, a milling tool is used to clear obstructions from the wellbore. However, milling obstructions in a wellbore with a milling tool leaves debris that must be collected before operations can begin or resume. The debris were conventionally collected using a separate tool. These two operations (e.g., milling and debris collection) are costly, time consuming, and inefficient. Thus, there is a need in the art for improvements in milling obstructions and collecting debris in a wellbore.

SUMMARY

A method for milling and removing debris in a wellbore, comprising: moving a collecting while milling (CWM) tool downhole into the wellbore with a wireline; and conducting a first operation with the CWM tool, wherein the first operation comprises: milling an obstruction disposed within the wellbore with the CWM tool, wherein the milling includes: engaging a milling bit of the CWM tool with the obstruction; rotating a shaft of a motor of the CWM tool at a first speed to rotate the milling bit and a pump of the CWM tool; monitoring an axial force applied to the obstruction by the CWM tool; and maintaining a first target power consumption of the motor while milling the obstruction by modifying the axial force applied to the obstruction by the CWM tool while rotating the shaft at the first speed; collecting debris generated from milling the obstruction, wherein the collecting includes: disengaging the milling bit from the obstruction by moving the CWM tool uphole a first distance; and maintaining a second target power consumption of the motor during the collection of debris generated from the milling of the obstruction, wherein maintaining the second target power consumption includes rotating the shaft of the motor at a second speed to drive the centrifugal pump to intake fluid from the wellbore to collect debris generated from milling the obstruction, wherein the second speed is greater than the first speed.

A collecting while milling (CWM) system for removing an obstruction in a wellbore, comprising a wireline connected to a wireline reel; and a CWM tool, including: a motor coupled to the wireline; a centrifugal pump rotationally coupled to a shaft of the motor; a milling bit rotationally coupled to the shaft of the motor, wherein the milling bit is rotatable to mill an obstruction in the wellbore; a tractor module coupled to the wireline, the tractor module configured to apply an axial force between the milling bit and the obstruction in a wellbore; a sensor configured to measure the axial force applied by the tractor module; and a control system. The control system configured to: conduct a first operation, wherein the first operation includes: engaging the milling bit with and applying the axial force to the obstruction with the tractor module; rotating the shaft of the motor at a first speed to rotate the milling bit and the centrifugal pump, wherein rotating the milling bit mills the obstruction; monitoring the axial force applied to the obstruction during milling of the obstruction; maintaining a first target power consumption of the motor while milling the obstruction by modifying the axial force applied by the tractor module while rotating the shaft at the first speed; disengaging the milling bit from the obstruction by moving the CWM tool uphole a first distance with the tractor module, while reeling in the wireline; and maintaining a second target power consumption of the motor, wherein maintaining the second target power consumption includes rotating the shaft of the motor at a second speed to drive the centrifugal pump to intake fluid from the wellbore to collect debris generated from milling the obstruction, wherein the second speed is greater than the first speed.

A method for milling and removing debris in a wellbore, comprising: moving a collecting while milling (CWM) tool downhole into the wellbore; and conducting a first operation with the CWM tool, wherein the first operation comprises: a first cycle including operating a motor of the CWM tool at a first torque and a first speed, wherein the first operation includes milling an obstruction in a wellbore; and a second cycle including operating the motor of the CWM tool at a second torque and second speed to power a centrifugal pump to circulate wellbore fluid through a bailer of the CWM tool to collect debris, wherein the first torque is greater than the second torque and the second speed is greater than the first speed.

BRIEF DESCRIPTION OF DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling,"

"couple," and "coupled" may include but are not limited to direct coupling and/or indirect coupling, such as indirect coupling through components such as links.

Aspects of the present disclosure provide systems, apparatus, and methods for collecting debris while milling an obstruction in a wellbore. Occasionally, there is a need to mill an obstruction in a wellbore and collect debris generated from milling the obstruction. The present disclosure generally relates to methods and apparatus to automate and increase efficiency of milling obstructions and collecting the generated debris. In some embodiments, the method includes operating a collecting while milling (CWM) tool to conduct a first operation and, optionally, a second operation. The first operation includes a milling sub-operation and a debris collection sub-operation. During the milling sub-operation, a CWM tool mills an obstruction with a milling bit while tool variables, such as motor rotational speed, tool push force, and motor torque, are controlled and optimized for milling. During the debris collection sub-operation, a pump of the CWM tool is operated to circulate wellbore fluid and collect debris in the wellbore while tool variables, such as motor rotational speed, tool push force, and motor torque, are controlled and optimized for debris collection. The second operation includes determining if the CWM tool is stuck and/or stalled and manipulating the CWM tool while continuing to operate the CWM tool to remedy the stalled or stuck condition.

Figure 1:
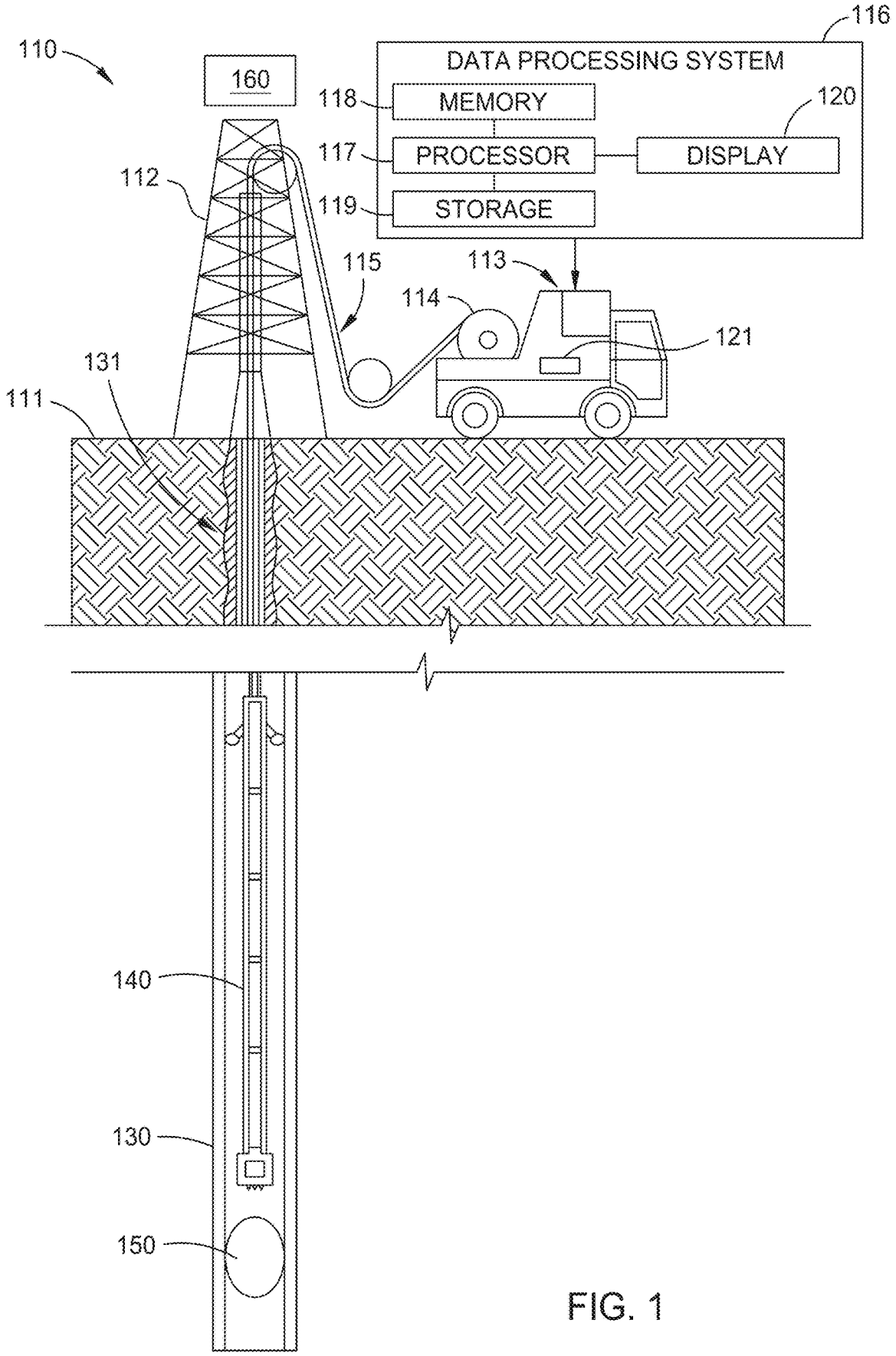
FIG. 1 illustrates an exemplary well site, according to one or more embodiments.

FIG. 1 illustrates an exemplary well site 110. The well site 110 includes a derrick 112 which may be used to raise and lower components into a wellbore 130 and otherwise assist in operations at the well site 110. While the well site 110 is shown as a terrestrial well site, the present disclosure is applicable to subsea operations.

The well site 110 also includes a wireline surface system 113 which includes a wireline logging unit 121, a wireline reel 114 (e.g., wireline depth control system), a wireline 115, and a control system 116. The control system 116 includes a processor 117, a memory 118, storage 119, and a display 120. The control system 116 may optionally be used to display and control various operations of the wireline surface system 113 and to send, receive, or store data to various tools and locations at, or remote to, the well site 110. The wireline 115 is coupled to a weight on bit ("WOB") sensor 160. The WOB sensor 160 can be used to measure an axial force applied by a tractor module of the tool 140. In some embodiments, the wireline surface system 113 includes a wireline tension sensor to determine the tension experienced by the wireline 115.

The wireline 115 is configured to transmit data, instructions, and telemetry to and between a collecting while milling (CWM) tool 140 in the wellbore 130 and the well site 110. The wireline 115 also supports the CWM tool 140 within the wellbore 130 and is able to manipulate the tool 140 within the wellbore 130. The wireline reel 114 reels in or reels out the wireline 115 to move (e.g. raise and lower) the CWM tool 140 within the wellbore 130.

The exemplary wellbore 130 is shown extending from the surface 111 into a formation 131 below the surface 111. An obstruction 150 (e.g., scale deposit, sand bridge, etc.) may be present in the wellbore that impedes operations within the wellbore 130. The obstruction is removed before the operations can begin or resume.

Figure 2:
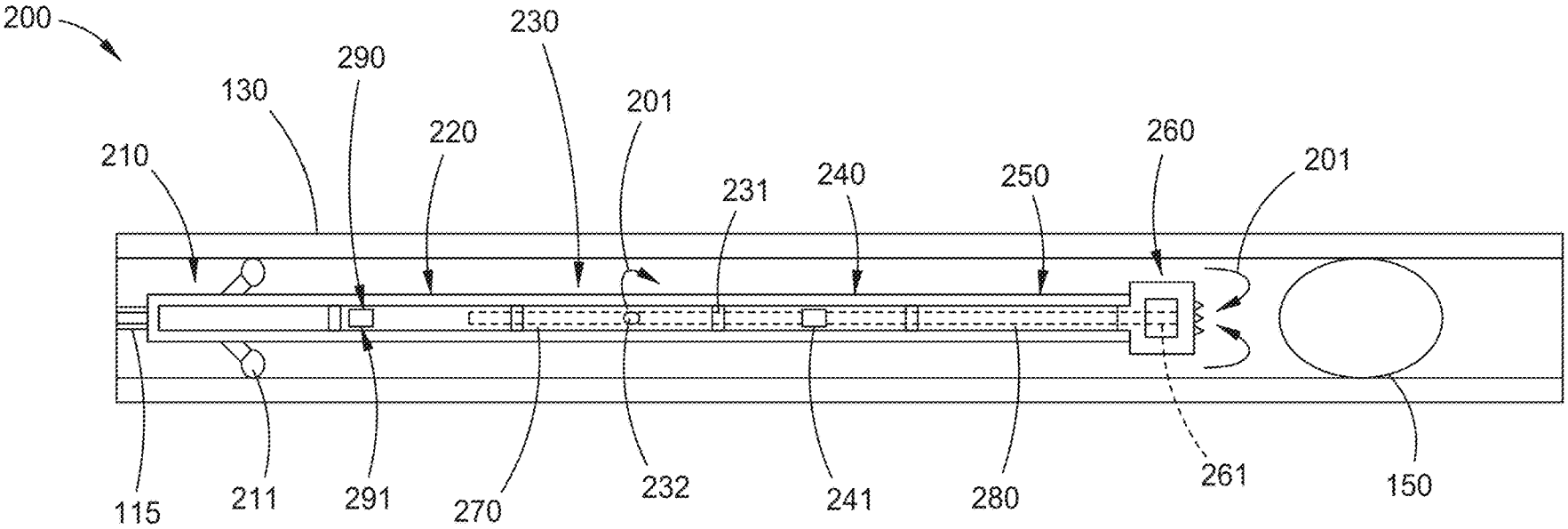
FIG. 2 illustrates a cross-sectional view of an exemplary collecting while milling (CWM) tool, according to one or more embodiments.

FIG. 2 illustrates a longitudinal cross-sectional view of an exemplary collecting while milling (CWM) tool 200 that can be used in place of the CWM tool 140 shown in FIG. 1.

The CWM tool 200 is a wireline tool coupled to the end of the wireline 115. The CWM tool 200 is conveyed into the wellbore 130 to remove obstructions, such as obstruction 150. The CWM tool 200 includes a tractor module 210, a motor 220, a centrifugal pump 230, a gearbox module 240, a bailer 250, a rotary tool 260 (such as a milling bit, referred to hereinafter as milling bit 260), an upper shaft 270, a lower shaft 280, and a control system 290.

The tractor module 210 includes a plurality of tractor arms 211. The tractor arms 211 may be used in conjunction with the wireline 115 to position CWM tool 200 within the wellbore 130. The tractor arms 211 can be used to force the milling bit 260 against the obstruction. In other words, the tractor module 210 may be used to apply a tractor force (e.g., downward axial force) to the obstruction 150 with the milling bit 260. In some embodiments, this amount of force applied by the tractor module 210 is measured by the WOB sensor 160. In some embodiments, the amount of force applied by the tractor module 210 is measured by a force sensor (e.g., force transducer) included in a sensor array 291 of the control system 290. The tractor module 210 selectively applies the desired tractor force based on instructions sent to the control system 290 of the CWM tool 200. In some embodiments, the instructions are sent from the surface 111 via the wireline 115 from the well site 110. In some embodiments, these instructions are stored on an onboard memory of the control system 290 of the CWM tool 200. In some embodiments, these instructions are dictated by operators near, at, or remote to, the well site 110 such as with control system 116.

The motor 220 is coupled to and rotates the upper shaft 270. The upper shaft 270 is connected to the lower shaft 280 via the gearbox module 240. The motor 220 rotates the upper shaft 270 to provide mechanical power to the CWM tool 200, such as driving the centrifugal pump 230 and the milling bit 260. In some embodiments, the motor 220 is an electric motor. In some embodiments, the rotational speed of the upper shaft 270 is controlled by instructions received by the CWM tool 200. In some embodiments, the rotational speed of the upper shaft 270 is controlled by instructions stored on the CWM tool 200.

The rotation of the upper shaft 270 by the motor 220 drives the centrifugal pump 230. The centrifugal pump 230 is configured to circulate wellbore fluid 201 through the CWM tool 200 to facilitate debris collection with the bailer 250. The centrifugal pump 230 includes an inlet 231 and an outlet 232. Wellbore fluid 201 is circulated from an inlet 231 of the centrifugal pump 230 through an outlet 232 of the centrifugal pump 230 into the wellbore 130.

The upper shaft 270 passes through the centrifugal pump 230 and is coupled to the gearbox module 240. The gearbox module 240 includes gearing 241 configured to transfer rotation from the upper shaft 270 to the lower shaft 280. The gearing 241 may be configured to change the rotational speed and/or torque of the lower shaft 280 relative to the upper shaft 270. In some embodiments, the gearing 241 is configured to increase the rotational speed and reduce torque of the lower shaft 280 relative to the upper shaft 270. In some embodiments, the gearing 241 may decrease the rotational speed and increase torque of the lower shaft 280 relative to the upper shaft 270.

The bailer 250 is fluidly coupled to the inlet 231 of the centrifugal pump 230 and is configured to separate solids from wellbore fluid 201 being pumped through the bailer 250 by the centrifugal pump 230 before the wellbore fluid 201 is pumped into the inlet 231 of the centrifugal pump 230. The bailer 250 may include one or more filter elements to facilitate filtering the debris from the wellbore fluid 201.

The lower shaft 280 passes through the bailer 250 and is coupled to, and drives, the milling bit 260. The milling bit 260 may include one or more intakes 261 (e.g. bore(s)) that allows wellbore fluid 201 to pass through the milling bit 260 and enter the bailer 250. In some embodiments, there is a single intake 261 and, in some embodiments, there may be a plurality of intakes 261 with varying positions and configurations. The wellbore fluid 201 flows through the bailer 250 and into the inlet 231 of the centrifugal pump 230. The wellbore fluid 201 travels through the centrifugal pump 230 before being pumped out of the outlet 232 and into the wellbore 130.

The control system 290 includes a sensor array 291 for measuring operational parameters including, but not limited to, speed of the tractor module 210, position of the tractor module 210, power consumption of the motor 220, current supplied to the motor 220, torque applied by the motor 220 to the upper shaft 270, rotational speed of the upper shaft 270, rotational speed of the lower shaft 280, tractor force, rotational speed of the centrifugal pump 230, torque of the centrifugal pump 230, rotational speed of the milling bit 260, torque of the milling bit 260, torque oscillation amplitude of the milling bit 260, position of the CWM tool 200, depth of the CWM tool 200, tension of the wireline 115, and/or accelerometers.

During operation, the motor 220 rotates the upper shaft 270 to power the centrifugal pump 230 to draw wellbore fluid 201 from the intake 261 of the milling bit 260 into the bailer 250 where debris are separated from the wellbore fluid 201 and collected in the bailer 250. The wellbore fluid 201 exiting the bailer 250 is pumped through the inlet 231 of the centrifugal pump 230 and out of the outlet 232 of the centrifugal pump 230 thereby circulating wellbore fluid 201 while collecting debris.

During operation, the rotation of motor 220 also causes the lower shaft 280 to rotate thereby rotating the milling bit 260. The rotation of the milling bit 260 allows the CWM tool 200 to mill obstructions with the milling bit 260, such as obstruction 150, while also collecting debris dispersed in the wellbore fluid 201 generated by milling the obstruction 150 by circulating the wellbore fluid 201 through the bailer 250. In some embodiments, debris is also collected in the bailer 250 that was not generated by milling the obstruction 150.

Therefore, the motor 220 simultaneously causes the rotation of both the centrifugal pump 230 and the milling bit 260. However, tool variables including, but not limited to motor torque, motor rotational speed, and weight on bit may be modified to optimize the operation for milling and/or collecting debris. For example, the motor 220 may be operated at a first desired speed when milling the obstruction 150 to facilitate efficient milling of the obstruction. However, the first desired speed may not cause significant circulation of the wellbore fluid 201 into the centrifugal pump 230. The CWM tool 200 may then be moved uphole by a distance, such as being moved 1 ft, to disengage the milling bit 260 from the obstruction 150 to facilitate debris collection. The motor 220 may be instructed to increase the rotational speed of the upper shaft 270 to a second desired speed during the collection of debris to circulate the wellbore fluid 201 through the CWM tool 200 to collect debris in the bailer 250. The increased second desired speed may cause the milling bit 260 to spin at a greater rate than during milling due to the gearing 241; however, the milling bit 260 freely spins during debris collection since the milling bit 260 is not engaged with the obstruction 150 and is therefore not actively milling.

It should be understood by one of ordinary skill that, because both the centrifugal pump 230 and the milling bit 260 are rotationally coupled to the motor 220, the torque and rotational speeds of the milling bit 260 are influenced by the torque, rotational speed, and power consumption of the motor 220 and the force applied by the tractor module 210.

Figure 3:
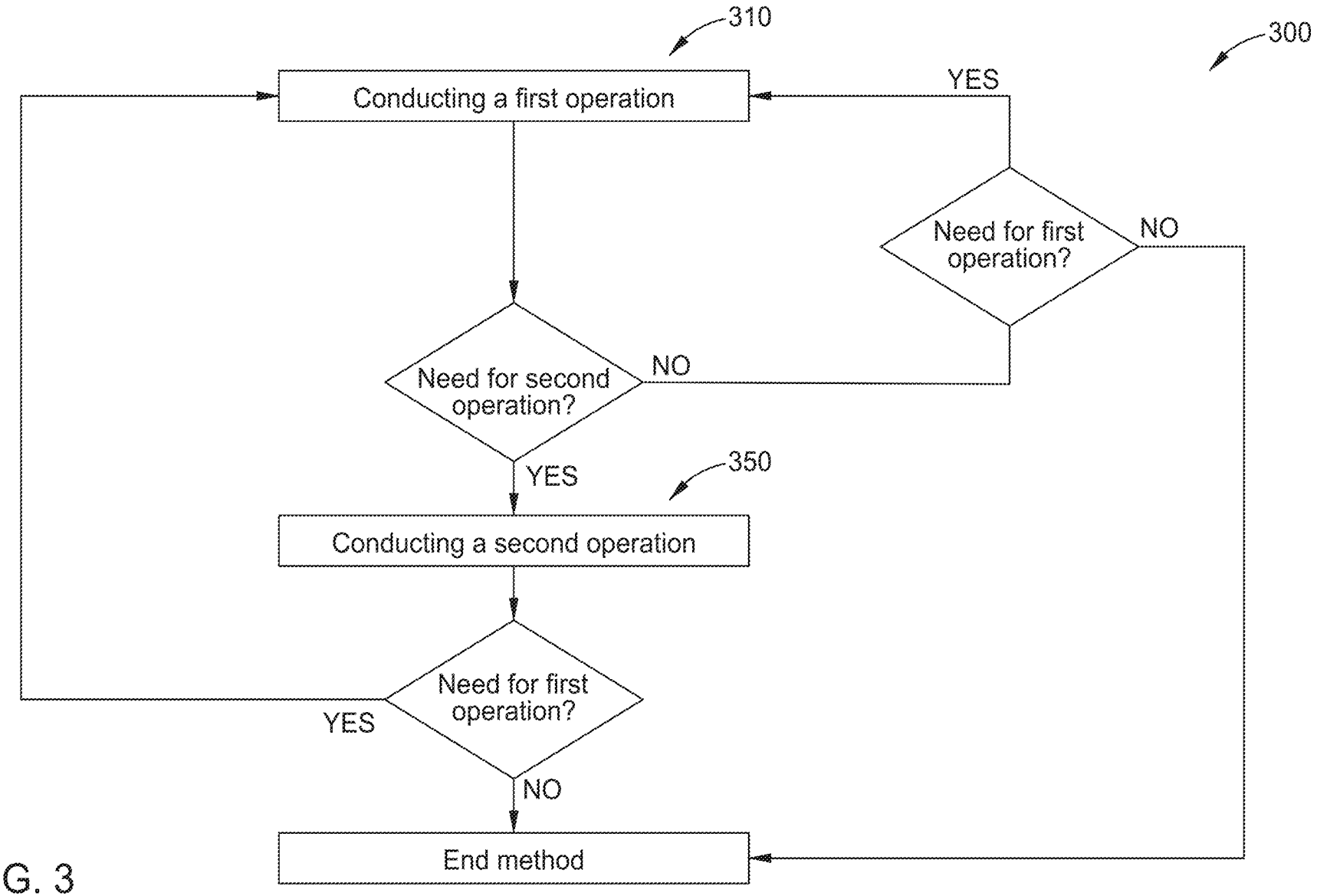
FIG. 3 illustrates an exemplary method for collecting debris while milling an obstruction in a wellbore, according to one or more embodiments.
Figure 4:
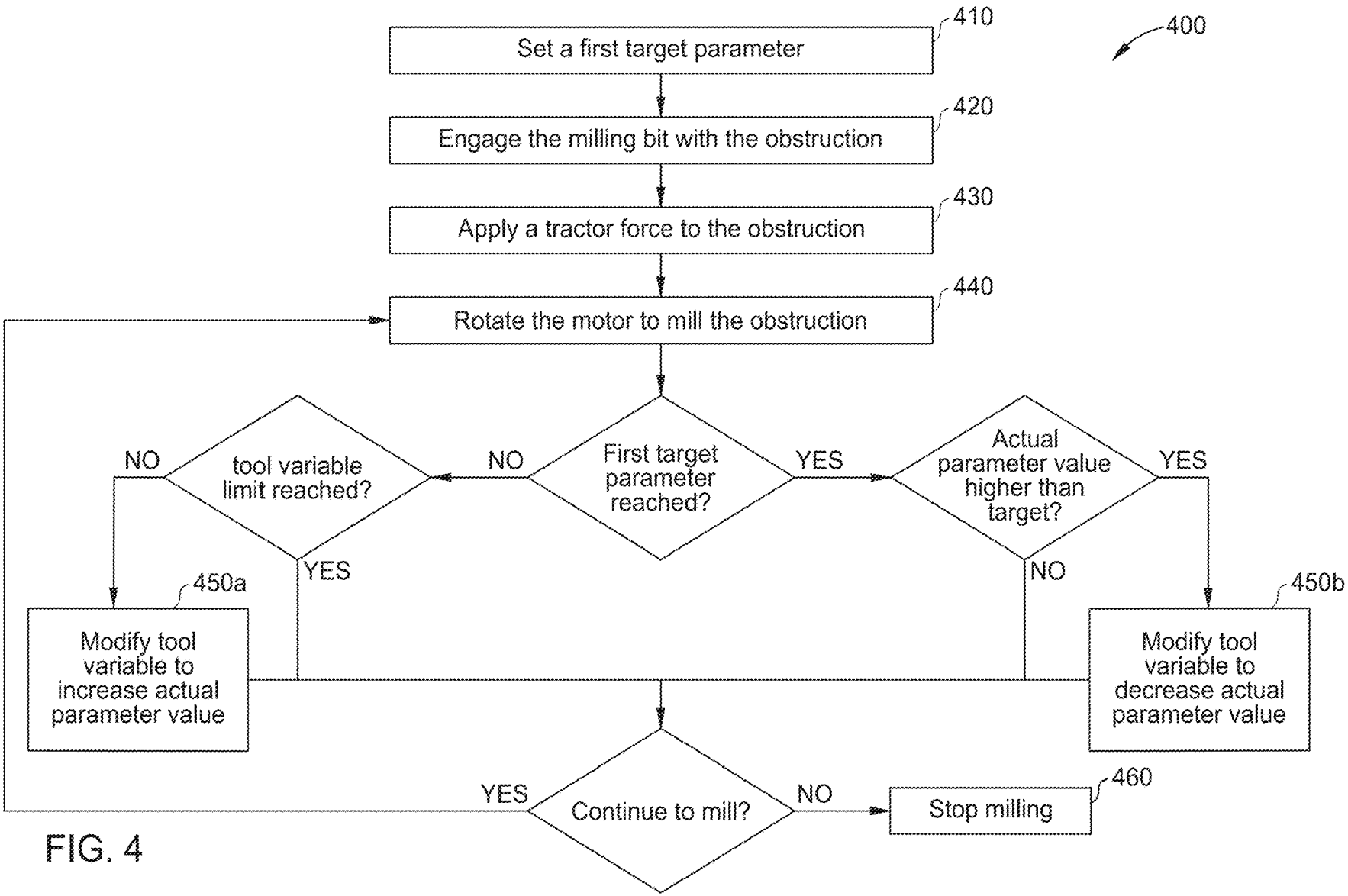
FIG. 4 illustrates a milling sub-operation of a first operation of the method of FIG. 3, according to one or more embodiments.
Figure 5:
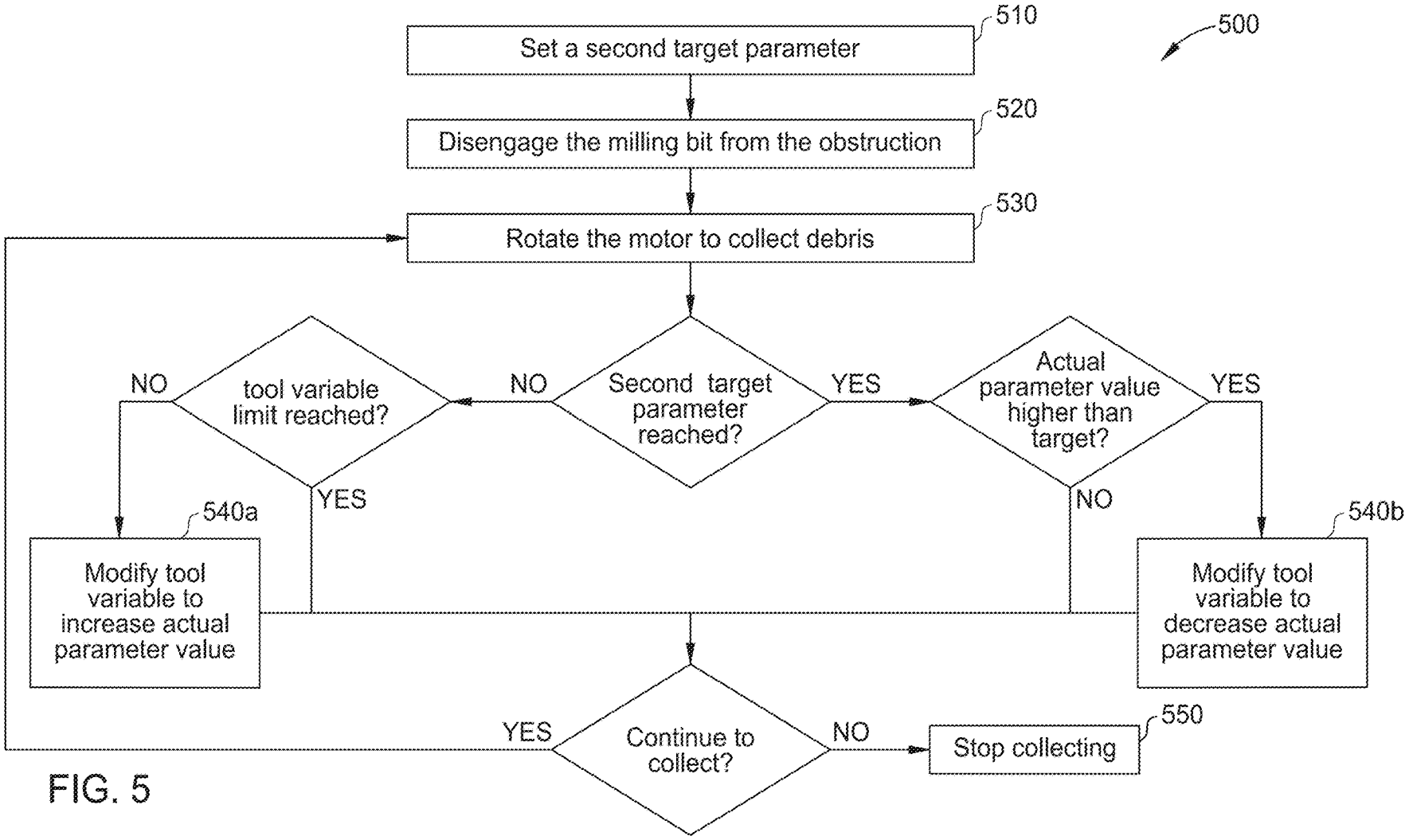
FIG. 5 illustrates a debris collection sub-operation of the first operation of the method of FIG. 3, according to one or more embodiments.

FIGS. 3-6 illustrate an exemplary method for collecting debris while milling obstruction 150 in the wellbore 130 with CWM tool 200. FIG. 3 illustrates an exemplary method 300 for collecting debris while milling obstructions including a first operation 310 and, optionally, a second operation 350. In some embodiments, where the CWM tool 200 uses a rotary tool other than a milling bit, the milling operation may be replaced with another operation, such as using a brush. The first operation 310 includes a milling sub-operation 400, as shown in FIG. 4 and a debris collection sub-operation 500 as shown in FIG. 5. In some embodiments, during the milling sub-operation 400, the motor 220 rotates the upper shaft 270 at a slower speed but a higher torque to optimize milling. Whereas, during the debris collection sub-operation 500, the motor 220 rotates the upper shaft 270 at a higher speed than the motor 220 rotates the upper shaft 270 during milling sub-operation 400 but a lower torque than the motor 220 rotates the upper shaft 270 during the milling sub-operation 400 to optimize debris collection. In some embodiments, during the milling sub-operation 400, the motor 220 rotates the upper shaft 270 at a higher speed but a lower torque to optimize milling. Whereas, in such embodiments, during the debris collection sub-operation 500, the motor 220 rotates the upper shaft 270 at a slower speed than the motor 220 rotates the upper shaft 270 during milling sub-operation 400 but a higher torque than the motor 220 rotates the upper shaft 270 during the milling sub-operation 400 to optimize debris collection.

Figure 6:
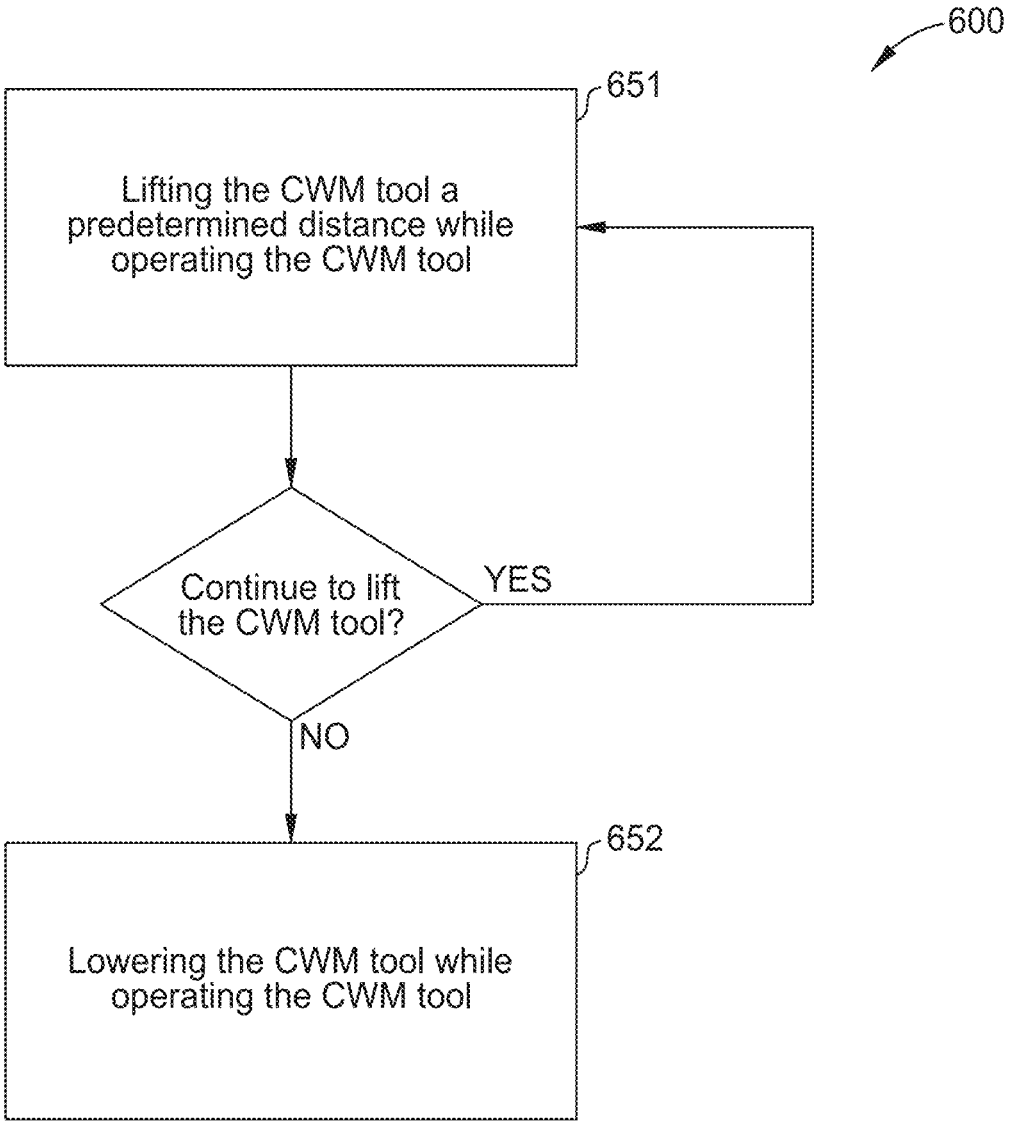
FIG. 6 illustrates a second operation of the method of FIG. 3, according to one or more embodiments.

The second operation 350 may be necessary after completing one or more first operations 310 as shown in FIG. 3. In the second operation 350 as shown in FIG. 6, the CWM tool 200 is moved uphole (e.g. lifted) a predetermined distance while operating and the lowered again if it is determined that the second operation 350 is necessary, for example if the CWM tool 200 is stuck, buried in debris, or stalled.

Referring to FIG. 4, the milling sub-operation 400 includes setting a target parameter of the CWM tool 200 at sub-operation 410. The target parameter may include, but is not limited to, desired motor power consumption, desired milling bit torque, and desired milling bit rotational speed. In embodiments where the target parameter is motor power consumption, the target may be between about 25% of maximum power and about 100% of maximum power. In some embodiments, the desired target motor power consumption is set to prevent damage to the motor 220, such as setting the target motor power consumption below 100% of maximum power. In embodiments where the target parameter is the rotational speed of the milling bit 260, the milling bit rotational speed is optimized for milling. In such embodiments, the target milling bit rotational speed may be about 0 rotations-per-minute (rpm) to about 100 rpm. In embodiments where the target parameter is milling bit torque, the target milling bit torque is optimized for milling. In such embodiments, the target milling bit torque may be about 0 ft lbs to about 1000 ft lbs.

The milling bit 260 is engaged with the obstruction at sub-operation 420. Engaging the milling bit with the obstruction includes lowering the CWM tool 200 with a wireline 115 and/or a tractor module 210 until the milling bit 260 engages the obstruction 150.

Once the milling bit 260 is engaged with the obstruction 150, an axial force (e.g., tractor force) is applied to the obstruction 150 by the milling bit 260 at sub-operation 430. The tractor force is applied to the obstruction by the milling bit 260 by at least one of moving the tractor 210 toward the obstruction 150 or allowing the weight of the CWM tool 200 to rest on the obstruction 150. The tractor force is measured by the WOB sensor 160 or the force sensor of the sensor array 291.

Before, after, or simultaneously with applying the tractor force to the obstruction 150, the motor 220 rotates the milling bit 260 to begin milling the obstruction 150 at sub-operation 440. While rotating the milling bit 260, the target parameter is monitored and tool variables (e.g. speed, torque, and tractor force) are modified at sub-operations 450*a* and 450*b* to meet the target parameter.

In embodiments where the target parameter is motor power consumption, the actual motor power consumption is monitored by one or more sensors of the sensor array 291 onboard the CWM tool 200, the control system 116 uphole of the CWM tool 200, or one or more operators. For example, the motor power consumption may be a product of motor speed and motor torque and motor torque may be determined by the motor current. Thus, the sensor array 291 may include a current meter and a speed sensor which may be used to compute motor power consumption.

If the actual motor power consumption is lower than the target motor power consumption one or more tool variables are modified at sub-operation 450*a* to increase the actual motor power consumption. For instance, the tractor force is increased (so long as the maximum tractor force has not been reached) while holding the rotational speed of the milling bit 260 constant to increase the actual motor power consumption. In the alternative, the tractor force is held constant and the rotational speed of the milling bit 260 is increased (so long as the maximum rotational speed of the milling bit 260 has not been reached) to increase the actual motor power consumption.

However, if the actual motor power consumption is higher than the target motor power consumption, one or more tool variables are modified at sub-operation 450*b* to decrease the actual motor power consumption. For instance, the tractor force is decreased while holding the rotational speed of the milling bit 260 constant to decrease the actual motor power consumption. In the alternative, the tractor force is held constant and the rotational speed of the milling bit 260 is decreased to decrease the actual motor power consumption.

If the actual motor power consumption equals the target motor power consumption, the one or more tool variables are held constant.

In embodiments where the target parameter is milling bit torque, the milling bit torque is monitored by control system 290 and the sensor array 291 onboard the CWM tool 200, the control system 116 uphole of the CWM tool 200, or one or more operators.

If the actual milling bit torque is lower than the target milling bit torque, one or more tool variables are modified to increase the actual milling bit torque at sub-operation 450*a*. For instance, the tractor force is increased (so long as the maximum tractor force has not been reached) while holding the rotational speed of the milling bit 260 constant to increase the actual milling bit torque. In the alternative, the tractor force is held constant and the rotational speed of the milling bit 260 is increased (so long as the maximum rotational speed of the milling bit 260 has not been reached) to increase the actual milling bit torque.

If the actual milling bit torque is higher than the target milling bit torque, one or more tool variables are modified at sub-operation 450*b* to decrease the actual milling bit torque. For instance, tractor force is decreased while holding the rotational speed of the milling bit 260 constant at to decrease the actual milling bit torque. In the alternative, the tractor force is held constant and the rotational speed of the milling bit 260 is decreased to decrease the actual milling bit torque.

If the actual milling bit torque equals the target milling bit torque, the one or more tool variables are held constant.

During the milling sub-operation 400, the CWM tool 200 is able to determine whether the wheels of tractor 210 is slipping using the sensor array 291. If the tractor 210 is slipping, push force generated by the tractor (e.g. tractor force) cannot be increased by increasing tractor motor synchronous speed. Slippage can be detected through the use of accelerometers on the CWM tool 200 detecting if the CWM tool 200 is experiencing jerk motion (e.g. determining there are different oscillation amplitudes and possible spikes on acceleration measurements). In some embodiments, the tractor speed and the milling bit torque are monitored to determine if the tractor 210 is slipping. In such instances, an increase in tractor speed without an increase in milling bit torque is indicative of tractor slippage. In response to determining the wheels of the tractor 210 are slipping, a force applied by the tractor arms 211 can be increased so as to prevent slippage.

After a period of milling, the milling sub-operation 400 stops at sub-operation 460. The decision to stop milling and move onto the debris collection sub-operation 500 of FIG. 5 may be made based on a period of time, average milling bit torque, milling bit torque behavior in response to push force changes, milling bit torque oscillation amplitude, wireline tension, tool position, and/or any combination thereof. In some embodiments, the debris collection sub-operation 500 is unnecessary since the debris is collected during sub-operation 400 and the method 300 is finished.

FIG. 5 illustrates a debris collection sub-operation 500 wherein the rotation of the centrifugal pump 230 is optimized to circulate wellbore fluid 201 to collect debris from the wellbore 130 that was or was not generated during sub-operating 400. After the decision has been made to begin a debris collection sub-operation 500, a target parameter is set at sub-operation 510. The target parameter may include, but is not limited to, desired motor power consumption, desired pump torque, and desired pump rotational speed. In embodiments where the target parameter is motor power consumption, the target may be between about 25% of maximum power and about 100% of maximum power. Setting a desired target motor power consumption prevents damage to the motor 220. In embodiments where the target parameter is pump rotational speed, the pump rotational speed is optimized for rotating the centrifugal pump to circulate drilling fluid to collect debris. In such embodiments, the target pump rotational speed may be about 4000 rmp to about 4500 rpm. In embodiments where the target parameter is pump torque, the target pump torque is optimized for collecting debris.

In some embodiments, the target parameter set at sub-operation 410 may be different from the target parameter set at sub-operation 510 in value or in type (i.e. the target parameter set at sub-operation 410 may be a target torque, whereas, the target parameter set at sub-operation 510 may be a target motor power consumption or the target parameter set at sub-operation 410 may be 80% of maximum power consumption, whereas, the target parameter set at sub-operation 510 may be 50% of maximum power consumption).

The milling bit 260 is disengaged from the obstruction 150 at sub-operation 520. In some embodiments, the milling bit 260 is disengaged from the obstruction 150 before setting the target parameter at sub-operation 510.

Disengaging the milling bit from the obstruction can include moving the CWM tool 200 uphole with the tractor module 210 and/or the wireline 115. In some embodiments, the tractor module 210 and the wireline 115 work simultaneously to move the CWM tool 200 uphole to minimize slack and/or tension in the wireline. When the milling bit 260 is lifted off of the obstruction 150 to disengage the milling bit 260 from the obstruction 150, the milling bit 260 may be moved uphole a short distance from the obstruction 150. This distance may be about 0" to about 15."

After disengaging the milling bit 260 from the obstruction 150, the motor 220 rotates the upper shaft 270 to drive the centrifugal pump 230 to pump wellbore fluid 201 and collect debris at sub-operation 530. The debris may be debris generated from the milling sub-operation 400 and/or the debris can be pre-existing debris in the wellbore 130. As the wellbore fluid 201 is circulated through the CWM tool 200 via the centrifugal pump 230, the debris is collected in the bailer 250 of the CWM tool 200.

In some embodiments, the motor begins rotating at a high speed in the debris collection sub-operation 500 and adjusts accordingly. While rotating the centrifugal pump 230, the target parameter is monitored and tool variables (e.g. pump rotational speed and pump torque) are modified at sub-operations 540*a* and 540*b* to meet the target parameter.

In embodiments where the target parameter is motor power consumption, the actual power consumption of the motor 220 is monitored by the control system 290 onboard the CWM tool 200, the control system 116 uphole of the CWM tool 200, or one or more operators. In some embodiments, the motor power consumption is computed as a product of motor speed and motor torque. Motor speed is measured via a sensor of the sensor array 291 and motor torque is computed based on motor current, which may be monitored by a 3-phase current sensor of the sensor array 291.

If the actual motor power consumption is lower than the target motor power consumption, one or more tool variables are modified at sub-operation 540*a* to increase the actual motor power consumption. For instance, the pump rotational speed is increased (so long as the maximum rotational speed of the centrifugal pump 230 has not been reached) to increase the actual motor power consumption. However, if the actual motor power consumption is higher than the target motor power consumption, one or more tool variables are modified at sub-operation 540*b* to decrease the actual motor power consumption. For instance, the pump rotational speed is decreased to decrease the actual motor power consumption. If the actual motor power consumption equals the target motor power consumption, the one or more tool variables are held constant.

In embodiments where the target parameter is pump torque, the pump torque is monitored by the control system 290 onboard the CWM tool 200, the control system 116 uphole of the CWM tool 200, or one or more operators. If the actual pump torque is lower than the target pump torque, one or more tool variables are modified to increase the actual pump torque at sub-operation 540*a*. For instance, the pump rotational speed is increased (so long as the maximum rotational speed of the centrifugal pump 230 has not been reached) to increase the actual pump torque. However, if the actual pump torque is higher than the target pump torque, one or more tool variables are modified at sub-operation 540*b* to decrease the actual pump torque. For instance, the pump rotational speed is decreased to decrease the actual pump torque. If the actual pump torque equals the target pump torque, the one or more tool variables are held constant.

In one or more embodiments, the tool variable being modified in sub-operations 540*a* and 540*b* may be the same tool variables being modified in sub-operations 450*a* and 450*b* or they may be different (i.e. at sub-operation 450*a* the tractor force is increased, whereas, at sub-operation 540*a* rotational speed is increased).

In some embodiments, the rotational speed, torque, and/or power consumption of the motor 220 in the milling sub-operation 400 are higher than those in the debris collection sub-operation 500. In some embodiments, the rotational speed, torque, and/or power consumption of the motor 220 in the milling sub-operation 400 are lower than those in the debris collection sub-operation 500.

After a period of collecting debris, the debris collection sub-operation 500 stops at sub-operation 550. The decision to stop collecting debris and either resume the milling sub-operation 400 of FIG. 4, move onto the second operation 350, or halt the method 300 may be made based on a period of time, average milling bit torque, milling bit torque behavior in response to push force changes, milling bit torque oscillation amplitude, wireline tension, tool position, a change in a pumping parameter, and/or any combination thereof. In some embodiments, the milling sub-operation 400 and/or the second operation 350 is unnecessary and the method 300 is finished.

In some instances, after a period of milling and debris collection, the bailer 250 will reach a maximum capacity wherein the bailer 250 is full of collected debris. In some cases, when the bailer 250 reaches the maximum capacity, the centrifugal pump 230 may experience a loss in suction which will cause the centrifugal pump 230 to need less power and the motor 220 will undergo a drop in power. Thus, monitoring power consumption of the motor 220 may be used to determine the available capacity of the bailer 250. When the bailer capacity reaches a certain threshold, the method 300 may be halted or paused and the CWM tool 200 may be returned to the surface to empty the bailer 250.

Referring back to FIG. 3, occasionally a second operation 350 is necessary after completing one or more first operations 310. In the second operation 350, the CWM tool 200 is moved uphole a predetermined distance while operating and is lowered a predetermined distance while operating. In some embodiments, the predetermined distance is in close proximity to the obstruction 150.

In some embodiments the second operation 350 may be necessitated when the CWM tool 200 is stuck or the milling bit 260 is stalled. In some embodiments, the tool stuck condition and/or the stalled milling bit condition is automatically detected and the second operation 350 is automatically commenced. The control system 290 onboard the CWM tool 200, the control system 116 uphole of the CWM tool 200, or one or more operators may determine a tool stuck or stalled milling bit condition. For instance, a tool position sensor may determine the CWM tool 200 is not moving while being instructed to do so, which indicates a tool stuck condition. Alternatively, the sensor array 291 may determine that the tractor force is indicative of a tool stuck condition. In some embodiments, a sensor, such as a sensor of the sensor array 291 (i.e. an accelerometer or wireline tension sensor), the WOB sensor 160, or a surface wireline tension sensor may sense that the CWM tool 200 or the wireline 115 is experiencing a downhole axial force counteracting the force needed to move the CWM tool 200 in the uphole direction while trying to move the CWM tool 200 in the uphole direction in either the debris collection sub-operation 500 or in sub-operation 651 described below, indicating that the CWM tool 200 is stuck. Similarly, a tool position sensor of the sensor array 291 may determine the CWM tool 200 is not moving while milling indicating a milling bit stalled or tool stuck condition. Further, a milling bit rotational speed sensor of the sensor array 291 may determine that the milling bit 260 is not rotating while being instructed to do so, which indicates a milling bit stalled condition.

In some embodiments, the decision to move onto the second operation 350 from the first operation 310 may be based on a period of time, average milling bit torque, milling bit torque behavior in response to push force changes, milling bit torque oscillation amplitude, wireline tension, tool position, and/or any combination thereof.

In some embodiments, the decision to move onto the second operation 350 is determined based on anomalies detected in the milling bit torque. Anomalies in milling bit torque may indicate that the milling bit 260 is interacting with debris around the milling bit 260 or the obstruction 150. If anomalies are detected, that will trigger a second operation 350.

Referring to FIG. 6, the second operation 350 includes a method 600 including sub-operation 651 and sub-operation 652. Sub-operation 651 includes moving the CWM tool 200 uphole, or attempting to move the CWM tool 200 uphole, a predetermined distance. The predetermined distance in sub-operation 651 is larger than the distance the CWM tool 200 is moved uphole at sub-operation 520 during the debris collection sub-operation 500. In some embodiments, the predetermined distance in sub-operation 651 is about 1 ft to about 10 ft. The wireline 115 and/or tractor module 210 are used to move the CWM tool 200 uphole and/or attempt to move the CWM tool 200 uphole at sub-operation 651.

While moving and/or attempting to move the CWM tool 200 uphole at sub-operation 651, the CWM tool 200 may optionally be operating in either a milling or a debris collection mode. That is, while moving the CWM tool 200 uphole, the motor 220 may rotate the milling bit 260 at a speed and torque optimized for milling similar to that in the milling sub-operation 400 described above. Alternatively, while moving the CWM tool 200 uphole, the motor 220 may rotate the centrifugal pump 230 at a speed and torque optimized for debris collection similar to the debris collection sub-operation 500 described above.

If necessary, sub-operation 651 is repeated if the condition necessitating the second operation 350 still exists. For instance, if the CWM tool 200 is still stuck or the milling bit 260 is still stalled, sub-operation 651 may be repeated.

During sub-operation 651, the torque applied to the milling bit 260 and/or the motor 220 is monitored for an anomaly that suggests the milling bit 260 is interacting with milled material around the milling bit 260. If the milling bit torque suggests the milling bit 260 is interacting with milled material, sub-operation 651 is repeated.

After moving the CWM tool 200 uphole and/or attempting to move the CWM tool 200 uphole the predetermined distance at sub-operation 651 and determining the CWM tool 200 is unstuck and/or no longer stalled, the CWM tool 200 is lowered in sub-operation 652. That is, once it is verified that the CWM tool 200 is unstuck and/or no longer stalled using one of the aforementioned methods of determining a stuck and/or stalled condition. The CWM tool 200 may be verified as unstuck and/or no longer stalled if the CWM tool can be moved uphole without significant resistance. The wireline 115 and/or tractor module 210 are used to lower the CWM tool 200. However, in some embodiments, method 300 may be stopped after moving the CWM tool 200 uphole and determining the CWM tool 200 is unstuck and/or no longer stalled at sub-operation 651.

While lowering the CWM tool 200 at sub-operation 652, the CWM tool 200 may optionally be operating in either a milling or a debris collection mode. That is, while lowering the CWM tool 200, the motor rotates the milling bit 260 at a speed and torque optimized for milling similar to that in the milling sub-operation 400 described above. Alternatively, while lowering the CWM tool 200, the motor 220 rotates the centrifugal pump 230 at a speed and torque optimized for debris collection similar to the debris collection sub-operation 500 described above.

After the CWM tool 200 is lowered at sub-operation 652, the method 300 resumes. Alternatively, in some embodiments, the method 300 can be ended after the CWM tool 200 is lowered at sub-operation 652. Referring again to FIG. 3, in some embodiments, the first operation 310 is repeated if necessary to complete the method 300, for instance, if the obstruction 150 is still impeding wellbore operations. However, in some embodiments, another first operation 310 is not necessary, and the method 300 is finished. The decision to repeat operation 310 or finish the method 300 of FIG. 3 may be made based on a period of time, average milling bit torque, milling bit torque behavior in response to changes in tractor force, milling bit torque oscillation amplitude, wireline tension, tool position, and/or any combination thereof.

When the method 300 is finished, at any point throughout the method 300, the CWM tool 200 is moved uphole to the surface.

Any one or more of the following operations, sub-operations, and steps may be instructed by the control system 116, operators, and or memory on the control system 290 onboard the CWM tool 200. Any one or more of the following operations, sub-operations, and steps may be controlled by the control system 116, the control system 290, and/or operators.

Any one or more components of the CWM tool 200 may be integrally formed together, directly coupled together, and/or indirectly coupled together and are not limited to the specific arrangement of components illustrated in FIGS. 1-2. Any one or more of the embodiments of the CWM tool 200 and/or the method 300 may be combined in whole or part with any one or more of the embodiments of the CWM tool 200 and/or the method 300. Any one or more of the operations, sub-operations, and steps of the method 300 may be combined in whole or in part with any one or more of the operations, sub-operations, and steps of method 300 and are not limited to the specific arrangement of operations, sub-operations, and steps as shown in FIGS. 3-6. Further, any one or more of the operations, sub-operations, and steps of the method 300 may be automated by, for example, one or more controllers of the CWM tool 200 (such as control system 290) and/or remote to the tool (such as control system 116) or may be controlled by an operator.

Example Aspects

Aspect 1: A method for milling and removing debris in a wellbore, comprising: moving a collecting while milling (CWM) tool downhole into the wellbore with a wireline; and conducting a first operation with the CWM tool, wherein the first operation comprises: milling an obstruction disposed within the wellbore with the CWM tool, wherein the milling includes: engaging a milling bit of the CWM tool with the obstruction; rotating a shaft of a motor of the CWM tool at a first speed to rotate the milling bit and a pump of the CWM tool; monitoring an axial force applied to the obstruction by the CWM tool; and maintaining a first target power consumption of the motor while milling the obstruction by modifying the axial force applied to the obstruction by the CWM tool while rotating the shaft at the first speed; collecting debris generated from milling the obstruction, wherein the collecting includes: disengaging the milling bit from the obstruction by moving the CWM tool uphole a first distance; and maintaining a second target power consumption of the motor during the collection of debris generated from the milling of the obstruction, wherein maintaining the second target power consumption includes rotating the shaft of the motor at a second speed to drive the centrifugal pump to intake fluid from the wellbore to collect debris generated from milling the obstruction, wherein the second speed is greater than the first speed.

Aspect 2: The method of Aspect 1, further comprising repeating the first operation at least once.

Aspect 3: The method of any combination of Aspects 1-2, further comprising: after conducting at least one first operation, determining a second operation is necessitated to collect the debris generated from milling the obstruction; and conducting the second operation.

Aspect 4: The method of Aspect 3, wherein determining the second operation is necessitated includes determining that the CWM tool is stuck or stalled.

Aspect 5: The method of any combination of Aspects 3-4, wherein the second operation comprises: moving the CWM tool uphole a second distance, wherein the second distance is greater than the first distance; and collecting the debris generated from milling the obstruction while moving the CWM tool uphole the second distance.

Aspect 6: The method of Aspect 5, wherein the second operation further comprises: determining the CWM tool is stuck; and continuing to move the CWM tool uphole while collecting the debris until the CWM tool is verified as unstuck.

Aspect 7: The method of Aspect 6, wherein determining the CWM tool is stuck includes measuring a position of the milling bit.

Aspect 8: The method of any combination of Aspects 6-7, wherein determining the CWM tool is stuck includes monitoring a second axial force needed to move the CWM tool uphole the second distance.

Aspect 9: The method of any combination of Aspects 6-8, wherein determining the CWM tool is stuck includes monitoring a second axial force needed to move the CWM tool uphole the second distance with a WOB sensor.

Aspect 10: The method of Aspect 5, wherein the second operation further comprises: determining the CWM tool is not stuck; and after moving the CWM tool the second distance, moving the CWM tool downhole while collecting debris generated from the milling.

Aspect 11: The method of Aspect 10, further comprising repeating the first operation after moving the CWM tool downhole.

Aspect 12: The method of any combinations of Aspects 1-11, wherein the CWM tool further comprises a tractor module configured to apply the axial force to the obstruction.

Aspect 13: A collecting while milling (CWM) system for removing an obstruction in a wellbore, comprising a wireline connected to a wireline reel; and a CWM tool, including: a motor coupled to the wireline; a centrifugal pump rotationally coupled to a shaft of the motor; a milling bit rotationally coupled to the shaft of the motor, wherein the milling bit is rotatable to mill an obstruction in the wellbore; a tractor module coupled to the wireline, the tractor module configured to apply an axial force between the milling bit and the obstruction in a wellbore; a sensor configured to measure the axial force applied by the tractor module; and a control system. The control system configured to: conduct a first operation, wherein the first operation includes: engaging the milling bit with and applying the axial force to the obstruction with the tractor module; rotating the shaft of the motor at a first speed to rotate the milling bit and the centrifugal pump, wherein rotating the milling bit mills the obstruction; monitoring the axial force applied to the obstruction during milling of the obstruction; maintaining a first target power consumption of the motor while milling the obstruction by modifying the axial force applied by the tractor module while rotating the shaft at the first speed; disengaging the milling bit from the obstruction by moving the CWM tool uphole a first distance with the tractor module, while reeling in the wireline; and maintaining a second target power consumption of the motor, wherein maintaining the second target power consumption includes rotating the shaft of the motor at a second speed to drive the centrifugal pump to intake fluid from the wellbore to collect debris generated from milling the obstruction, wherein the second speed is greater than the first speed.

Aspect 14: The CWM system of Aspect 13, wherein the control system is further configured to repeat the first operation at least once.

Aspect 15: The CWM system of any combination of Aspects 13-14, wherein the control system is further configured to: determine a second operation is necessitated to collect the debris generated from milling the obstruction after conducting the first operation; and conduct the second operation.

Aspect 16: The CWM system of Aspect 15, wherein determining the second operation is necessitated includes one or more of reaching a set length of time and reaching a set axial force monitored by the control system.

Aspect 17: The CWM system of any combination of Aspects 15-16, wherein the second operation comprises: moving the CWM tool uphole a second distance with the tractor module while also reeling in the wireline, wherein the second distance is greater than the first distance; and collecting the debris generated from milling the obstruction while moving the CWM tool uphole the second distance, while reeling in the wireline.

Aspect 18: The CWM system of Aspect 17, wherein the second operation further comprises: determining the CWM tool is stuck; and continuing to move the CWM tool uphole while collecting the debris until the CWM tool is verified as unstuck.

Aspect 19: The CWM system of Aspect 17, wherein the second operation further comprises: determining the CWM tool is not stuck; and after moving the CWM tool the second distance, moving the CWM tool downhole while collecting debris generated from the milling.

Aspect 20: The CWM system of Aspect 19, wherein the control system is further configured to repeat the first operation after moving the CWM tool downhole.

Aspect 21: The CWM system of any combination of Aspects 13-20, further comprising a bailer, wherein the bailer stores the debris collected by the centrifugal pump.

Aspect 22: The CWM system of any combination of Aspects 13-21, wherein the control system is further configured to pump the intake fluid out of the centrifugal pump and back into the wellbore.

Aspect 23: A method for milling and removing debris in a wellbore, comprising: moving a collecting while milling (CWM) tool downhole into the wellbore; and conducting a first operation with the CWM tool, wherein the first operation comprises: a first cycle including operating a motor of the CWM tool at a first torque and a first speed, wherein the first operation includes milling an obstruction in a wellbore; and a second cycle including operating the motor of the CWM tool at a second torque and second speed to power a centrifugal pump to circulate wellbore fluid through a bailer of the CWM tool to collect debris, wherein the first torque is greater than the second torque and the second speed is greater than the first speed.

Aspect 24: The method of Aspect 23, further comprising: alternating between the first cycle and the second cycle, wherein the first cycle and second cycles are alternated based on one or more of time, average motor torque, maximum motor torque, motor torque behavior in response to a force applied to the obstruction by the CWM tool, motor torque oscillation amplitude, position of the CWM tool, and axial force applied by a tractor module of the CWM tool.

Aspect 25: The method of any combination of Aspects 23-24, wherein: the first cycle includes maintaining a target power consumption of the motor while rotating the motor at a first speed; and the second cycle includes maintaining a second target power consumption of the motor while rotating the motor at the second speed.

Aspect 26: The method of any combination of Aspects 23-25, further comprising conducting a second operation, including: moving the CWM tool uphole a predetermined distance; operating the motor of the CWM tool at a third speed and third torque to power the centrifugal pump to circulate wellbore fluid through a bailer of the CWM tool to collect debris and to rotate the milling bit; and moving the CWM tool downhole the predetermined distance.

While the present disclosure has been described with respect to a number of embodiments and examples, those skilled in the art, having benefit of this disclosure, will appreciate that other embodiments can be devised which do not depart from the scope and spirit of the present disclosure.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

What is claimed is:

1. A method for milling and removing debris in a wellbore, comprising:

moving a collecting while milling (CWM) tool downhole into the wellbore with a wireline; and conducting a first operation with the CWM tool, wherein the first operation comprises:

milling an obstruction disposed within the wellbore with the CWM tool, wherein the milling includes:

engaging a milling bit or other rotary tool of the CWM tool with the obstruction;

rotating a shaft of a motor of the CWM tool at a first speed to rotate the milling bit or the other rotary tool and a pump of the CWM tool;

monitoring an axial force applied to the obstruction by the CWM tool; and maintaining a first target power consumption of the motor while milling the obstruction by modifying the axial force applied to the obstruction by the CWM tool while rotating the shaft at the first speed;

collecting debris generated from milling the obstruction, wherein the collecting includes:

disengaging the milling bit or the other rotary tool from the obstruction by moving the CWM tool uphole a first distance; and maintaining a second target power consumption of the motor during the collection of the debris generated from the milling of the obstruction, wherein maintaining the second target power consumption includes rotating the shaft of the motor at a second speed to drive the pump to intake fluid from the wellbore to collect the debris generated from milling the obstruction, wherein the second speed is greater than the first speed.

2. The method of claim 1, further comprising repeating the first operation at least once.

3. The method of claim 1, further comprising:

after conducting at least one first operation, determining a second operation is necessitated to collect the debris generated from milling the obstruction; and conducting the second operation.

4. The method of claim 3, wherein determining the second operation is necessitated includes determining that the CWM tool is stuck or stalled.

5. The method of claim 3, wherein the second operation comprises:

moving the CWM tool uphole a second distance, wherein the second distance is greater than the first distance; and collecting the debris generated from milling the obstruction while moving the CWM tool uphole the second distance.

6. The method of claim 5, wherein the second operation further comprises:

determining the CWM tool is stuck; and continuing to move the CWM tool uphole while collecting the debris until the CWM tool is verified as unstuck.

7. The method of claim 6, wherein determining the CWM tool is stuck includes measuring a position of the milling bit or the other rotary tool.

8. The method of claim 6, wherein determining the CWM tool is stuck includes monitoring a second axial force needed to move the CWM tool uphole the second distance.

9. The method of claim 6, wherein determining the CWM tool is stuck includes monitoring a second axial force needed to move the CWM tool uphole the second distance with a WOB sensor.

10. The method of claim 5, wherein the second operation further comprises:

determining the CWM tool is not stuck; and after moving the CWM tool the second distance, moving the CWM tool downhole while collecting the debris generated from the milling.

11. The method of claim 10, further comprising repeating the first operation after moving the CWM tool downhole.

12. The method of claim 1, wherein the CWM tool further comprises a tractor module configured to apply the axial force to the obstruction.

13. A collecting while milling (CWM) system for removing an obstruction in a wellbore, comprising:

a wireline connected to a wireline reel; and a CWM tool, including:

a motor coupled to the wireline;

a centrifugal pump rotationally coupled to a shaft of the motor;

a milling bit or other rotary tool rotationally coupled to the shaft of the motor, wherein the milling bit or the other rotary tool is rotatable to mill the obstruction in the wellbore;

a tractor module coupled to the wireline, the tractor module configured to apply an axial force between the milling bit or the other rotary tool and the obstruction in the wellbore;

a sensor configured to measure the axial force applied by the tractor module; and a control system, the control system configured to:

conduct a first operation, wherein the first operation includes:

engaging the milling bit or the other rotary tool with and applying the axial force to the obstruction with the tractor module;

rotating the shaft of the motor at a first speed to rotate the milling bit or the other rotary tool and the centrifugal pump, wherein rotating the milling bit or the other rotary tool mills the obstruction;

monitoring the axial force applied to the obstruction during milling of the obstruction;

maintaining a first target power consumption of the motor while milling the obstruction by modifying the axial force applied by the tractor module while rotating the shaft at the first speed;

disengaging the milling bit or the other rotary tool from the obstruction by moving the CWM tool uphole a first distance with the tractor module, while reeling in the wireline; and maintaining a second target power consumption of the motor, wherein maintaining the second target power consumption includes rotating the shaft of the motor at a second speed to drive the centrifugal pump to intake fluid from the wellbore to collect debris generated from milling the obstruction, wherein the second speed is greater than the first speed.

14. The CWM system of claim 13, wherein the control system is further configured to repeat the first operation at least once.

15. The CWM system of claim 13, wherein the control system is further configured to:

determine a second operation is necessitated to collect the debris generated from milling the obstruction after conducting the first operation; and conduct the second operation.

16. The CWM system of claim 15, wherein determining the second operation is necessitated includes one or more of reaching a set length of time and reaching a set axial force monitored by the control system.

17. The CWM system of claim 15, wherein the second operation comprises:

moving the CWM tool uphole a second distance with the tractor module while also reeling in the wireline, wherein the second distance is greater than the first distance; and collecting the debris generated from milling the obstruction while moving the CWM tool uphole the second distance, while reeling in the wireline.

18. The CWM system of claim 17, wherein the second operation further comprises:

determining the CWM tool is stuck; and continuing to move the CWM tool uphole while collecting the debris until the CWM tool is verified as unstuck.

19. The CWM system of claim 17, wherein the second operation further comprises:

determining the CWM tool is not stuck; and after moving the CWM tool the second distance, moving the CWM tool downhole while collecting the debris generated from the milling.

20. The CWM system of claim 19, wherein the control system is further configured to repeat the first operation after moving the CWM tool downhole.

21. The CWM system of claim 13, further comprising a bailer, wherein the bailer stores the debris collected by the centrifugal pump.

22. The CWM system of claim 13, wherein the control system is further configured to pump the intake fluid out of the centrifugal pump and back into the wellbore.

23. A method for milling and removing debris in a wellbore, comprising:

moving a collecting while milling (CWM) tool downhole into the wellbore; and conducting a first operation with the CWM tool, wherein the first operation comprises:

a first cycle including operating a motor of the CWM tool at a first torque and a first speed, wherein the first operation includes milling an obstruction in the wellbore; and a second cycle including operating the motor of the CWM tool at a second torque and second speed to power a centrifugal pump to circulate wellbore fluid through a bailer of the CMW tool to collect the debris, wherein the first torque is greater than the second torque and the second speed is greater than the first speed.

24. The method of claim 23, further comprising:

alternating between the first cycle and the second cycle, wherein the first and second cycles are alternated based on one or more of time, average motor torque, maximum motor torque, motor torque behavior in response to a force applied to the obstruction by the CWM tool, motor torque oscillation amplitude, position of the CWM tool, and axial force applied by a tractor module of the CWM tool.

25. The method of claim 23, wherein:

the first cycle includes maintaining a target power consumption of the motor while rotating the motor at the first speed; and the second cycle includes maintaining a second target power consumption of the motor while rotating the motor at the second speed.

26. The method of claim 23, further comprising conducting a second operation, including:

moving the CWM tool uphole a predetermined distance;

operating the motor of the CWM tool at a third speed and third torque to power the centrifugal pump to circulate the wellbore fluid through the bailer of the CWM tool to collect the debris and to rotate a milling bit or other rotary tool; and moving the CWM tool downhole the predetermined distance.

* * * * *